US007464516B2

(12) United States Patent
Johnson

(10) Patent No.: US 7,464,516 B2
(45) Date of Patent: Dec. 16, 2008

(54) OVER-WRAP APPARATUS AND METHOD FOR A BOBBIN AND PAPER

(75) Inventor: David Allen Johnson, Jackson, NJ (US)

(73) Assignee: Schweitzer-Manduit International, Inc., Alpharetta, GA (US)

( * ) Notice: Subject to any disclaimer, the term of this patent is extended or adjusted under 35 U.S.C. 154(b) by 104 days.

(21) Appl. No.: 11/635,808

(22) Filed: Dec. 7, 2006

(65) Prior Publication Data

US 2008/0134635 A1 Jun. 12, 2008

(51) Int. Cl.
*B65B 13/02* (2006.01)

(52) U.S. Cl. ..... 53/399; 53/133.7; 53/409; 53/587

(58) Field of Classification Search ..... 53/133.7, 53/397, 399, 409, 465, 581, 582, 587, 588; 206/389
See application file for complete search history.

(56) References Cited

U.S. PATENT DOCUMENTS 1,779,578 A * 10/1930 Andersen ..... 53/133.7
1,949,259 A * 2/1934 Salsman ..... 206/389
3,390,762 A * 7/1968 Mernieks ..... 242/160.4
3,505,150 A * 4/1970 Andersson ..... 156/187
3,660,958 A * 5/1972 Garrison ..... 53/399
4,229,925 A * 10/1980 Stirniman ..... 53/399
4,508,773 A * 4/1985 Maxwell ..... 428/198
4,581,083 A * 4/1986 Schutz et al. ..... 156/187
5,388,775 A * 2/1995 Duguay ..... 242/160.1
5,555,978 A * 9/1996 Elsner ..... 206/389
5,765,340 A * 6/1998 Ekblom ..... 53/399
5,790,912 A * 8/1998 Myers ..... 206/389
5,927,047 A * 7/1999 Bartels ..... 53/399
6,186,326 B1 * 2/2001 Pienta et al. ..... 53/399
2002/0192406 A1 * 12/2002 Labbe et al. ..... 53/465

FOREIGN PATENT DOCUMENTS

EP 0588758 A1 3/1994
WO WO 02092713 A1 11/2002

OTHER PUBLICATIONS

PCT Search Report for International Application No. PCT/US2007/083725, completed Mar. 25, 2008.

* cited by examiner

*Primary Examiner*—Louis K Huynh
(74) *Attorney, Agent, or Firm*—Dority & Manning, P.A.

(57) ABSTRACT

A system and method for placing an overwrap material on a bobbin of material is disclosed. The bobbin of material may be, for instance, a bobbin of paper, such as cigarette paper. The system automatically attaches the overwrap material to a leading edge of the bobbin, wraps the bobbin in the overwrap material, cuts the overwrap material, and secures the overwrap material to the bobbin. The overwrap material is used to protect the bobbin during shipping and storage. The overwrap material can also be used to assist in feeding of the bobbin of material into a process.

9 Claims, 13 Drawing Sheets

OVER-WRAP APPARATUS AND METHOD FOR A BOBBIN AND PAPER

BACKGROUND

Many sheet-like products, such as paper products, are spirally wound into bobbins for sale to wholesalers, retailers, consumers and other manufacturing entities. In order to protect the bobbins during shipment and storage, an overwrap material is typically wound around the bobbin to protect its contents.

For example, cigarette papers, such as outer wrappers, inner wrappers, filter papers, porous plug wrap papers, and the like, are typically supplied to cigarette makers in the form of a spirally wound bobbins. A heavier overwrap material, such as a heavier paper, is typically attached to the leading edge of the cigarette paper and wound around the circumference of the bobbin. The end of the overwrap material is then adhesively secured so that the paper product does not unwind until the product is needed.

Cigarette manufacturers are known to provide vary detailed specifications as to not only the construction of the overwrap material but how the overwrap material is applied to the bobbin. The overwrap material, for instance, is typically used as a leader for threading the cigarette paper through a cigarette making machine. Thus, cigarette manufacturers typically have requirements for the overwrap material that make the overwrap material compatible with the cigarette making machines.

In the past, the process for applying the overwrap material to the bobbin has been tedious and labor intensive. For instance, the overwrap material is typically applied to cigarette paper by an operator after parent bobbins have been produced. For example, an operator may need to attach the overwrap material to the cigarette paper and apply adhesive where necessary. After the overwrap material is placed on the parent bobbin, the bobbin is then typically run through a slitter so as to produce multiple bobbins having a desired width.

After the overwrap material is applied, the individual bobbins are then typically subject to inspection prior to shipment to a customer. In fact, not only is the process for applying the overwrap material labor intensive, but, since it is typically carried out by an operator, the resulting bobbin products may not always be uniform. In view of the above, a need currently exists for a system and method for applying an overwrap material to a bobbin of sheet-like material, such as a bobbin of paper. In particular, a need exists for a system and method that is capable of automatically applying the overwrap material to a bobbin while staying within customer required specifications.

SUMMARY

In general, the present disclosure is directed to an automated system for applying an overwrap material to a bobbin and to a corresponding method. The present disclosure is also directed to a method of opening a sealed spirally wound bobbin of material.

In one embodiment, for instance, a method for overwrapping a paper bobbin includes the steps of loading a bobbin of spirally wound paper on a mandrel. Although depending upon the particular circumstances, an outer layer of paper of the bobbin may be adhesively secured to the outer circumference of the bobbin prior to attaching an overwrap material. In order to initially break the outer layer open, a breakfoot is placed against an outer circumference of the bobbin. The breakfoot, for instance, may comprise a hydraulic or pneumatic actuator.

Once the breakfoot is placed against the outer circumference, the outer layer of paper is then pulled causing the outer layer to break at a location adjacent to the breakfoot. The paper may be pulled, for instance, by applying a suction force against the outer layer.

Once the bobbin of paper is broken open, the bobbin can be partially unwound in order to remove at least a portion of the outer layer of paper. The outer layer can then be cut in order to form a leading edge.

The leading edge of the bobbin can then be attached to a leading edge of an overwrap material by applying an adhesive material in between the leading edge of the paper and the leading edge of the overwrap material.

Once the overwrap material is adhesively secured to the leading edge of the bobbin, the bobbin can be wound in order to wrap the overwrap material around the bobbin. A second adhesive material may then be applied to the overwrap material and the overwrap material may be cut upstream from the location where the second adhesive material has been placed. The trailing edge of the overwrap material can then be adhered to the outer circumference of the bobbin using the second adhesive material. In one embodiment, the adhesive material may be placed upstream from the trailing edge in order to form a pullable tab that allows the overwrap material to be broken open when the bobbin of paper is ready to be used.

In one embodiment, once the leading edge of the bobbin is formed, the leading edge may be drawn against a vacuum roll positioned adjacent to the bobbin. The leading edge of the overwrap material, on the other hand, may be held on a vacuum plate that is suspended over the vacuum roll. An adhesive applicator may apply an adhesive material to the leading edge of the overwrap material in order to secure the overwrap material to the leading edge of the bobbin.

The second adhesive material that is used to secure the trailing edge of the overwrap material to the circumference of the bobbin may comprise, for instance, a two sided cleavable tape. The second adhesive material may be applied to the overwrap material at a distance upstream from the bobbin that is equal to or greater than about 75% of the circumference of the bobbin.

The present disclosure is also directed to a system for applying an overwrap material onto a bobbin of paper. The system includes a mandrel for receiving a bobbin of paper. A vacuum roller is positioned adjacent to the mandrel. The vacuum roller is configured to hold a leading edge of a bobbin of paper loaded on the mandrel. A moveable gripping device, such as a vacuum plate, is configured to hold a leading edge of an overwrap material proximate to the vacuum roller. The gripping device can be moveable towards the vacuum roller for contacting the leading edge of the overwrap material with the leading edge of the bobbin of paper.

An adhesive applicator may be provided that applies adhesive to the overwrap material for attaching the leading edge of the overwrap material to the leading edge of the bobbin of paper when the leading edges are contacted with one another.

The system may further include a tape applicator that applies a double-sided adhesive tape to the overwrap material downstream from the leading edge of the overwrap material. A first cutting device can be used to cut the overwrap material after the bobbin of paper has been wound. The cutting device can also be configured to cut the overwrap material downstream from the adhesive tape so that the adhesive tape can secure the overwrap material to the outside circumference of the bobbin of paper.

In one embodiment, when it is necessary to initially break open the bobbin of paper, the system can further include at least one breakfoot that is moveable onto and away from the circumference of the bobbin positioned on the mandrel. The system can also include a moveable suction device positioned proximate to the breakfoot. The suction device can be configured to pull against an outer layer of the paper causing the paper to break open adjacent to the breakfoot.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
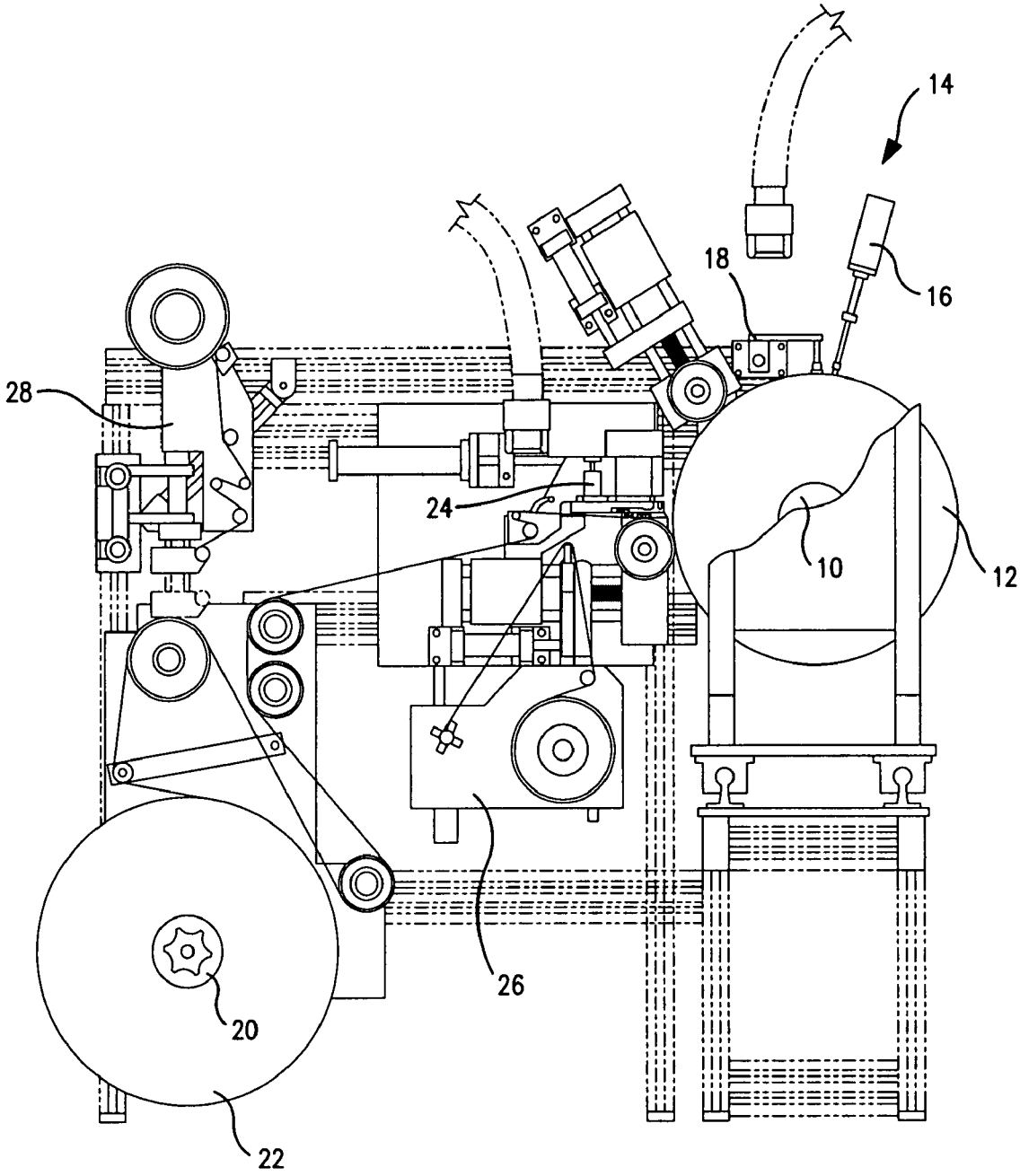
FIG. 1 is a side view of one embodiment of a system for applying an overwrap material onto a bobbin of material in accordance with the present disclosure.

Repeat use of reference characters in the present specification and drawings is intended to represent same or analogous features or elements of the present disclosure.

DETAILED DESCRIPTION

It is to be understood by one of ordinary skill in the art that the present discussion is a description of exemplary embodiments only, and is not intended as limiting the broader aspects of the present invention.

In general, the present disclosure is directed to a system and method for applying an overwrap material onto a bobbin of material. In one embodiment, for instance, the bobbin comprises of a roll of paper, such as cigarette paper. It should be understood, however, that virtually any spirally wound roll of material may be overwrapped with the system and process of the present disclosure.

As will be explained in more detail below, the system of the present disclosure provides various benefits and advantages. For instance, the system is capable of automatically applying an overwrap material around the circumference of a bobbin of material. By being fully automated, the process of applying the overwrap material is not labor intensive and is much faster than a manual process. Also, the system is capable of placing the overwrap material on a bobbin within carefully controlled limits. In addition, the system is capable of producing wrapped bobbins that are uniform and consistent with little to no variation in the overwrap properties.

Referring to FIG. 1, for example, one embodiment in a system for applying an overwrap material to a bobbin is illustrated. As shown, the system includes a mandrel 10 for holding a bobbin of material 12. For instance, in one embodiment, the bobbin 12 can be a bobbin of paper, such as cigarette paper. It should be understood, however, that any suitable bobbin of material may be loaded on the mandrel 10.

In some embodiments, the bobbin 12 may be supplied in a sealed condition. For instance, the leading edge of the paper or other material may be adhesively adhered to the circumference of the bobbin. In these embodiments, a breaking device 14 may be included in the system for initially breaking opening the bobbin. The breaking device 14 can include at least one breakfoot 16 located proximate to a suction device 18. As will be described in greater detail below, the breaking device 14 is capable of breaking open the bobbin 12 in order to form a leading edge for attachment to an overwrap material.

As shown in FIG. 1, the system includes an overwrap supply 20 containing a roll of overwrap material 22. As shown, the overwrap material is threaded through the apparatus. A leading edge of the overwrap material is held by a gripping device 24. The gripping device 24 can be any suitable device capable of holding and releasing the free end of the overwrap material. In one embodiment, for instance, the gripping device 24 may comprise a vacuum plate that has a top surface and a bottom surface. The bottom surface of the vacuum plate may be configured to hold the leading edge of the overwrap material by applying a suction force to the overwrap material.

In order to apply a first adhesive material to the overwrap material 22 in order to attach the overwrap material to a leading edge of the bobbin of paper 12, the system includes an adhesive applicator 26. In addition, the system includes a tape applicator 28 located downstream on the overwrap material from the adhesive applicator 26. The tape applicator 28 is configured to apply a second adhesive material, such as a double-sided tape to the overwrap material for adhering the trailing edge of the overwrap material to the bobbin of paper 12 after the overwrap material has been wrapped around the bobbin and cut.

Generally, when applying an overwrap material to a bobbin, the bobbin 12 is first loaded on the mandrel 10. For instance, in one embodiment, a robot can be configured to lift the bobbin from a bobbin supply and properly position the bobbin on the mandrel 10.

Figure 2A:
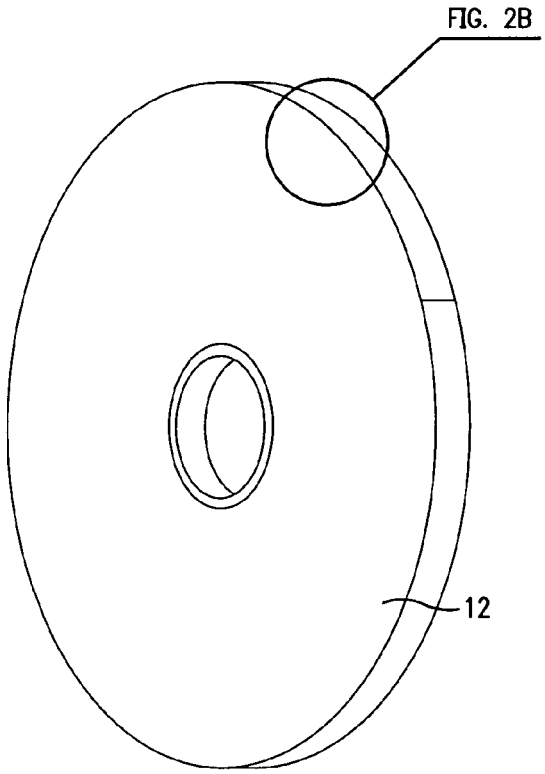
FIGS. 2A and 2B are perspective views of a bobbin of material that is to be loaded in the system as illustrated in FIG. 1.
Figure 2B:
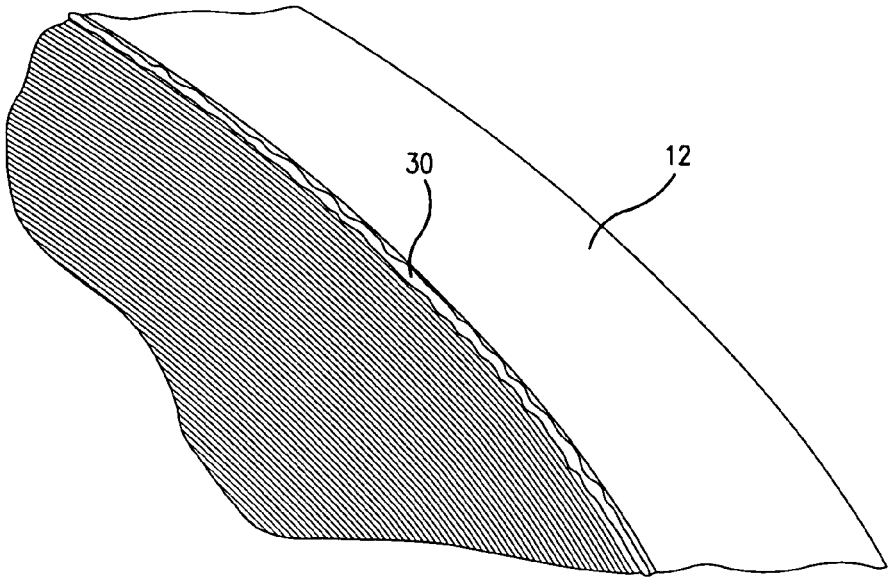

One example of a bobbin 12 is shown in FIGS. 2A and 2B. As described above, in some applications, bobbins to be fed into the system are supplied in a sealed state. More particularly, as shown in FIG. 2B, the leading edge of the bobbin may be adhered to the outer circumference of the bobbin using an adhesive 30. In these applications, the bobbin must first be broken open prior to applying the overwrap material to the bobbin especially in applications such as cigarette papers where the overwrap material may later be used to feed the bobbin of paper into a process.

Figure 3A:
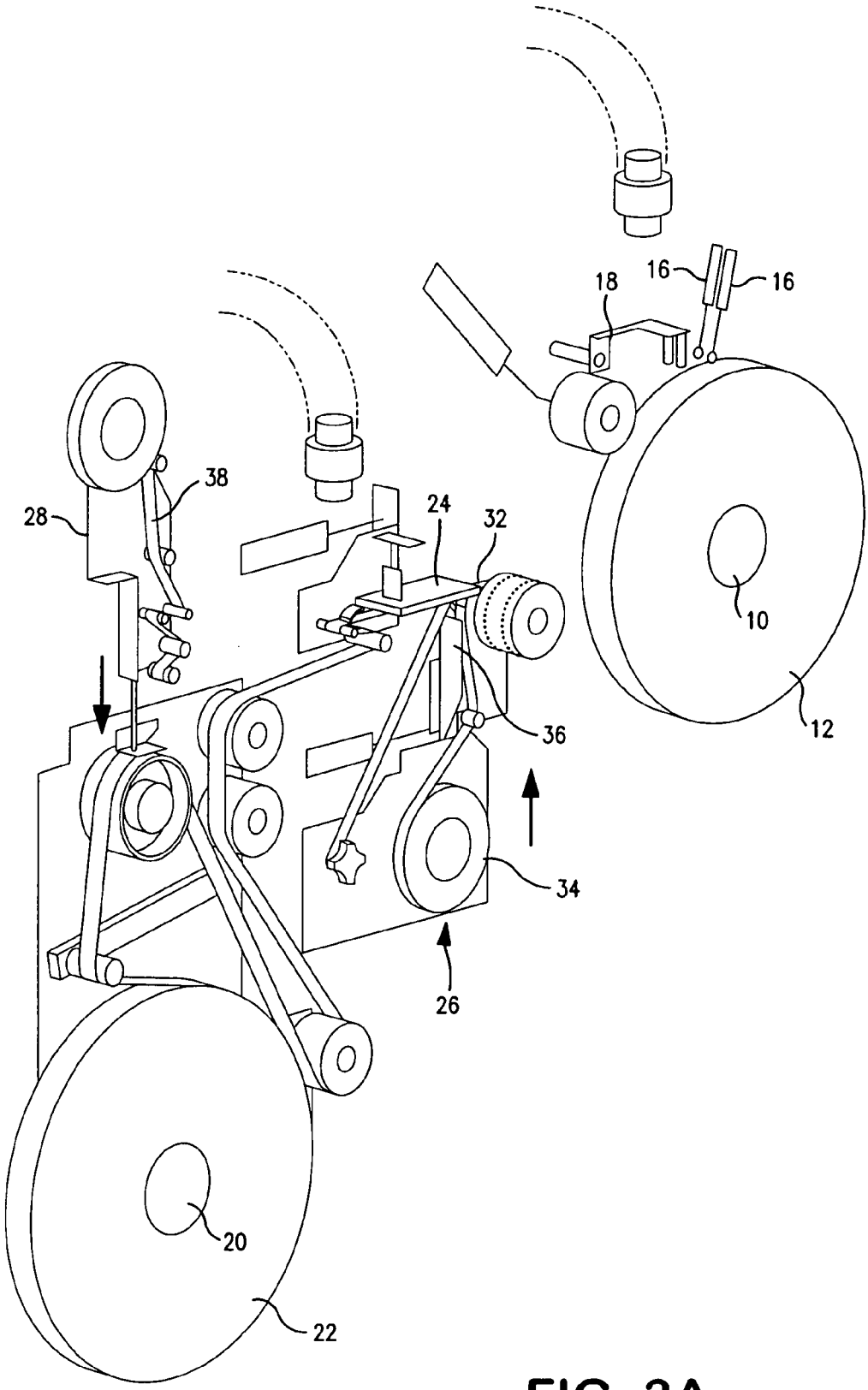
FIGS. 3A through 3J are perspective views illustrating the manner in which the system illustrated in FIG. 1 is used to apply an overwrap material to a bobbin of material.

Referring to FIGS. 3A through 3J, one embodiment of a process by which the bobbin 12 is broken open and wrapped with an overwrap material is shown. As shown in FIG. 3A, the bobbin 12 is loaded on the mandrel 10. In this first step, the adhesive applicator 26 applies an adhesive to the overwrap material at a location proximate to a leading edge 32 of the overwrap material 22. As shown, the leading edge 32 of the overwrap material is held against the vacuum plate 24. The adhesive applicator 26 moves toward the leading edge 32 and applies an adhesive. In particular, in this embodiment, the adhesive applied to the overwrap material is supplied on a release tape 34. As shown, a pressing device 36 moves upwards causing the release tape 34 to contact the leading edge 32 of the overwrap material 22. When contact is made, an adhesive on the release tape is transferred to the leading edge 32.

As also shown in FIG. 3A, a second adhesive material is also applied to the overwrap material downstream from the leading edge 32. In particular, the tape applicator 28 applies a double-sided adhesive tape 38 to the overwrap material 22. The double-sided adhesive tape will later be used to seal the trailing edge of the overwrap material to the circumference of the bobbin 12. In one embodiment, the double-sided adhesive tape 38 that is applied to the overwrap material 22 includes a first side and a second side. The first side is the side that is applied to the overwrap material. The second side, on the other hand, may be protected with a backing material that protects the second side of adhesive until the trailing edge of the overwrap material is adhered to the bobbin. As will be described later, the process can be configured to automatically remove the backing material as the overwrap material advances.

Figure 3B:
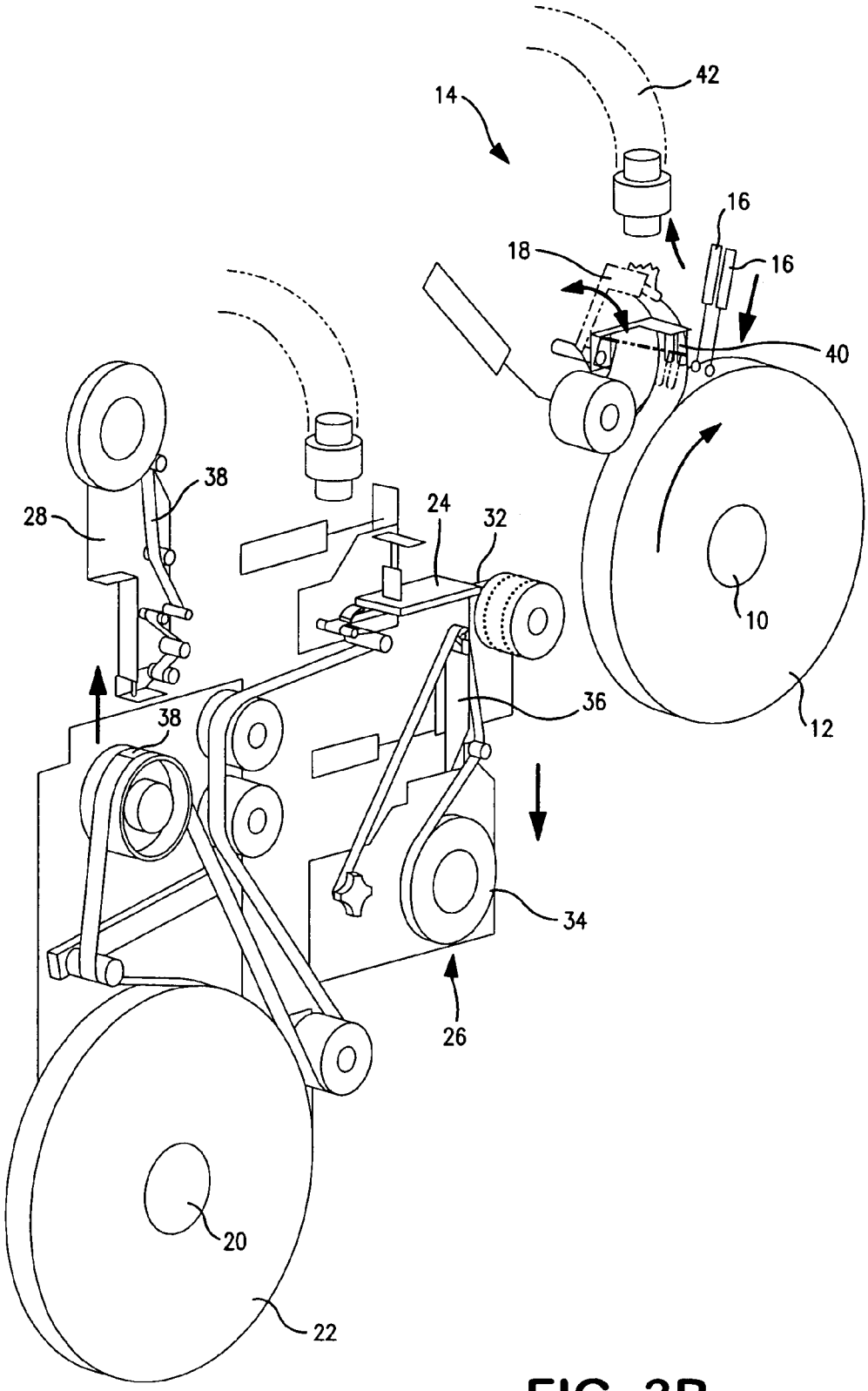

Referring to FIG. 3B, once the adhesive material is applied to the leading edge 32 of the overwrap material 22, the adhesive applicator 26 moves downward and disengages. Similarly, the tape applicator 28 also disengages from the overwrap material 22 once the double-sided tape 38 is applied to the overwrap material.

As also shown in FIG. 3B, the bobbin of paper 12 is broken open using the breaking device 14. In particular, in order to break open the outer layer of paper, at least one breakfoot 16 is applied against the outer circumference of the bobbin 12. In FIG. 3B, for instance, a pair of breakfeet 16 are shown. Each breakfoot can be any suitable device that is capable of applying pressure against the outer circumference. For instance, in one embodiment, each breakfoot may comprise a hydraulic or pneumatic cylinder.

After the breakfeet 16 are applied against the outer circumference of the bobbin 12, the suction device 18 applies a suction force to the outer layer of paper and then pivots away from the outer circumference as shown in FIG. 3B. The suction device, for instance, may include at least one suction nozzle 40 such as a pair of suction nozzles. The suction nozzles apply a suction force to the outer layer of paper. As the suction device pivots away from the outer circumference, the outer layer of paper rips and breaks at a location adjacent to the breakfeet 16. A vacuum hose 42 is then activated which captures the free end of the outer layer of paper where the break has occurred.

Figure 3C:
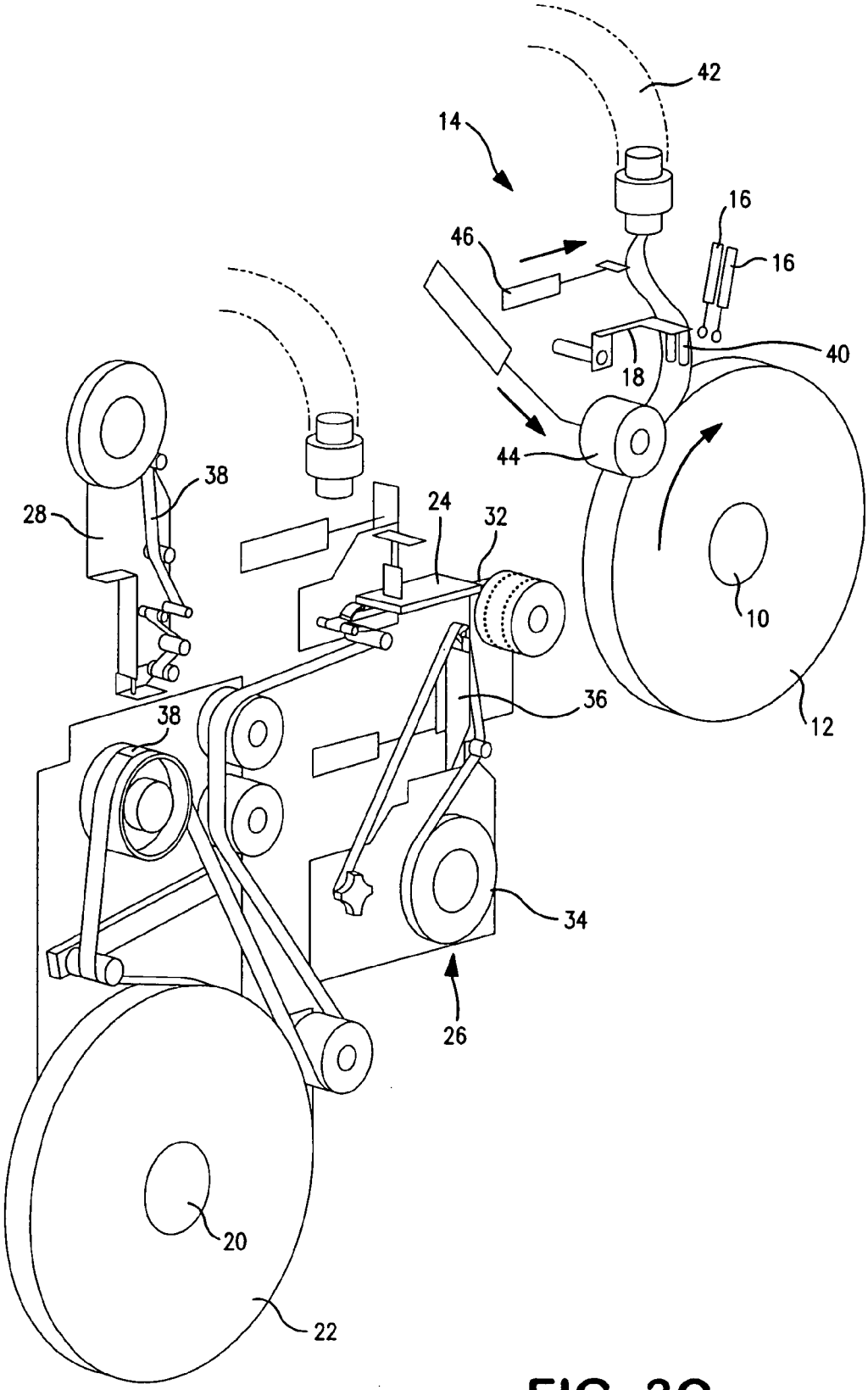

Referring to FIG. 3C, after the outer layer of paper is broken open, the mandrel 10 rotates (clockwise in this embodiment) so as to remove the entire outer layer of paper. For instance, in one embodiment, the mandrel can be rotated from one to three revolutions. As the mandrel 10 is rotated, the outer layer of paper is captured by the vacuum hose 42.

After the mandrel 10 has rotated, a clamping device 44 is pressed against the outer circumference of the bobbin 12. The clamping device 44 as shown in FIG. 3C can be a movable roller that moves toward and away from the bobbin. The clamping device holds the outer layer of paper against the bobbin as the paper is cut by a cutting device 46. The cutting device 46 can comprise any suitable cutting device and may vary depending upon the type of material present on the bobbin 12. For instance, the cutting device 46 may have a blade that strikes against a backing plate causing the paper to cut. Cutting the paper creates a leading edge 48 as shown in FIG. 3D.

Figure 3D:
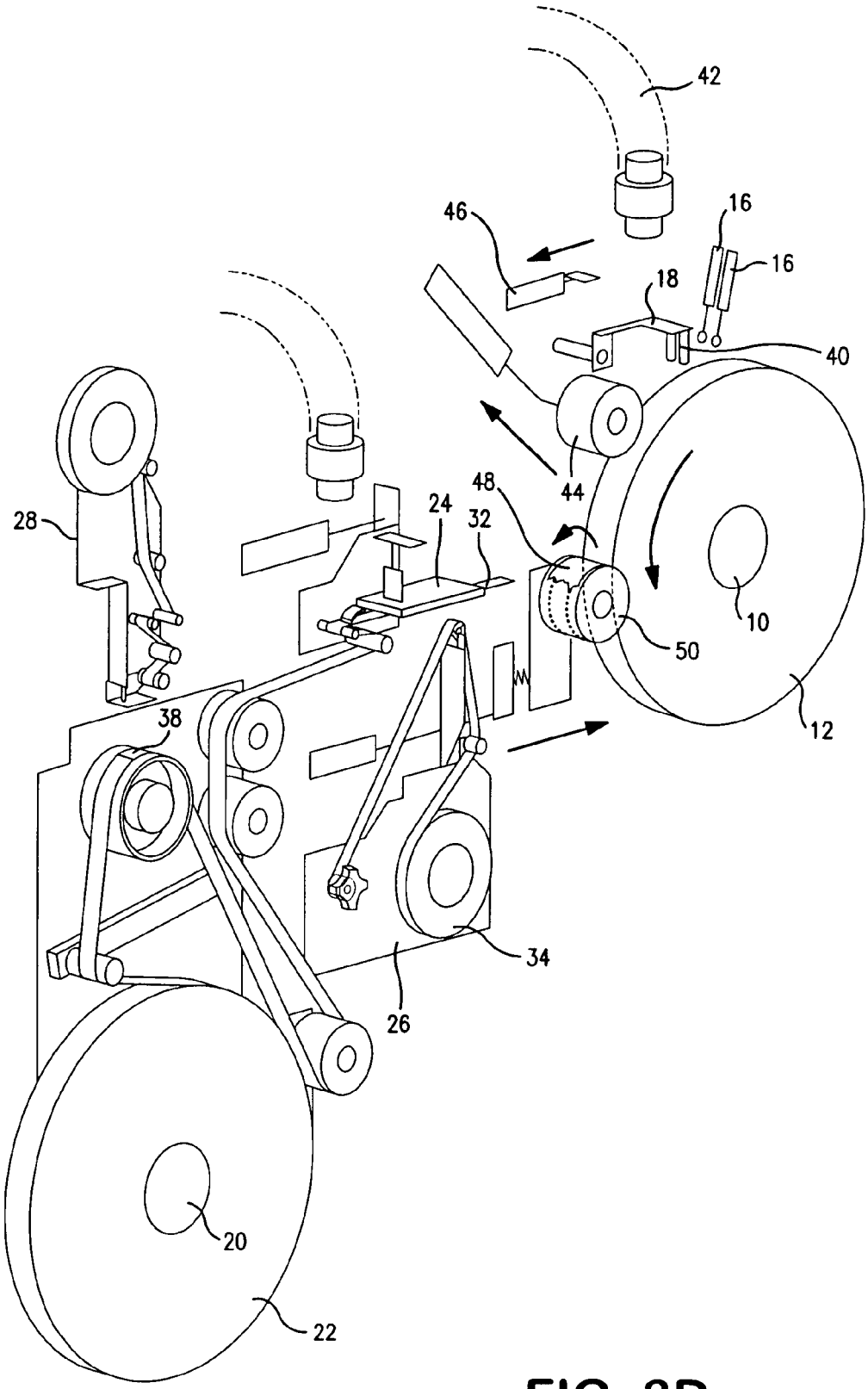

Referring to FIG. 3D, once the leading edge 48 is formed, the clamping device 44 is moved out of engagement with the bobbin 12. A vacuum roller 50 is then activated as the mandrel 10 is rotated. The vacuum roller 50 moves towards the bobbin 12. Due to the suction force created by the vacuum roller 50, the leading edge is drawn to and positioned on the vacuum roller.

Figure 3E:
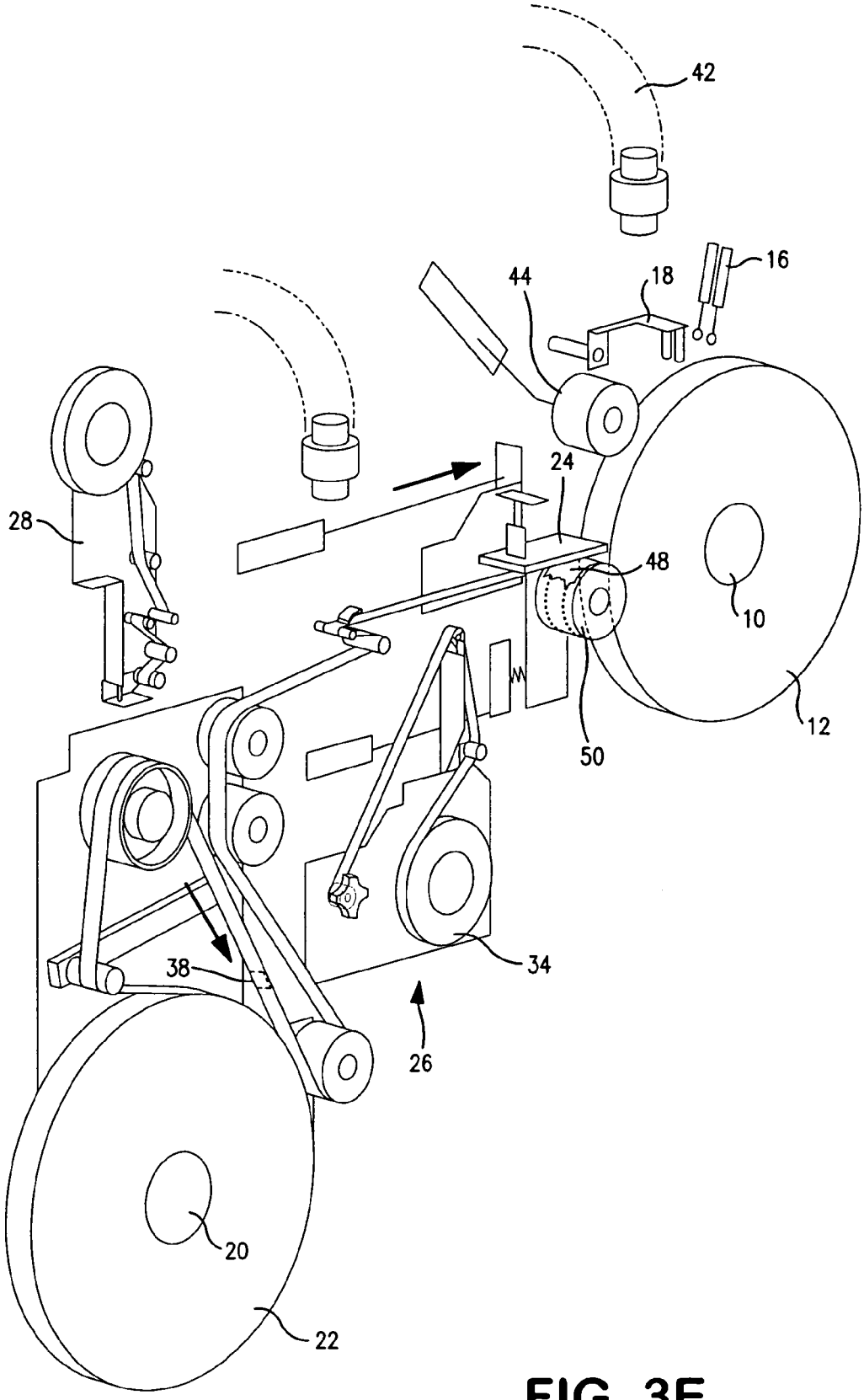
Figure 3F:
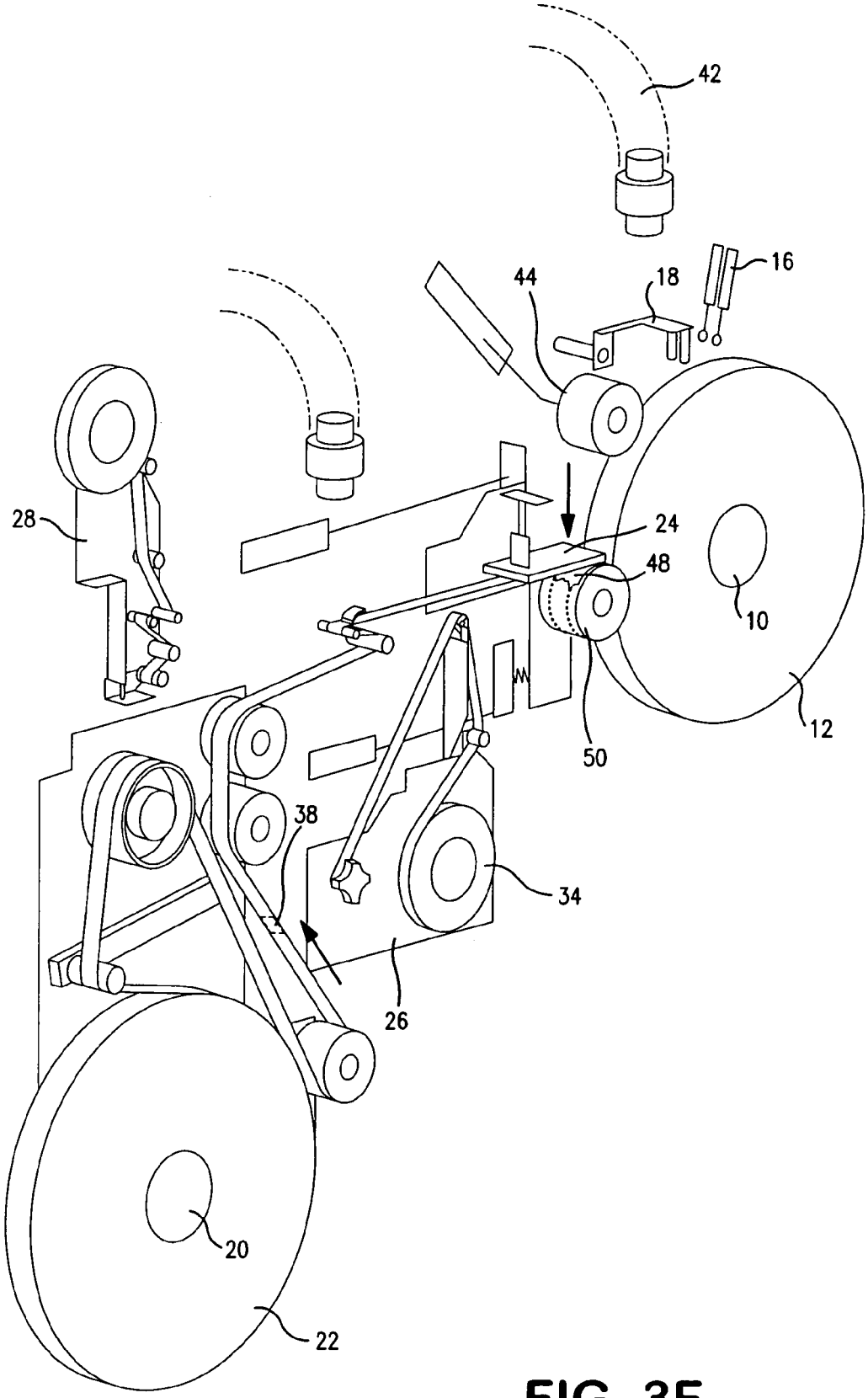

As shown in FIG. 3E, once the leading edge 48 of the bobbin of material 12 is positioned on the vacuum roller 50, the vacuum plate 24 holding the leading edge of the overwrap material is advanced towards the vacuum roller. More particularly, the vacuum plate 24 moves above the vacuum roller 50 and, as shown in FIG. 3F, then moves downward so as to contact the leading edge of the overwrap material with the leading edge of the bobbin. Due to the adhesive that has already been placed on the overwrap material, the overwrap material becomes connected to the bobbin of paper.

As shown in FIGS. 3E and 3F, as the vacuum plate 24 moves forward, the vacuum plate pulls on the overwrap material causing the overwrap material to unwind and advance.

Figure 3G:
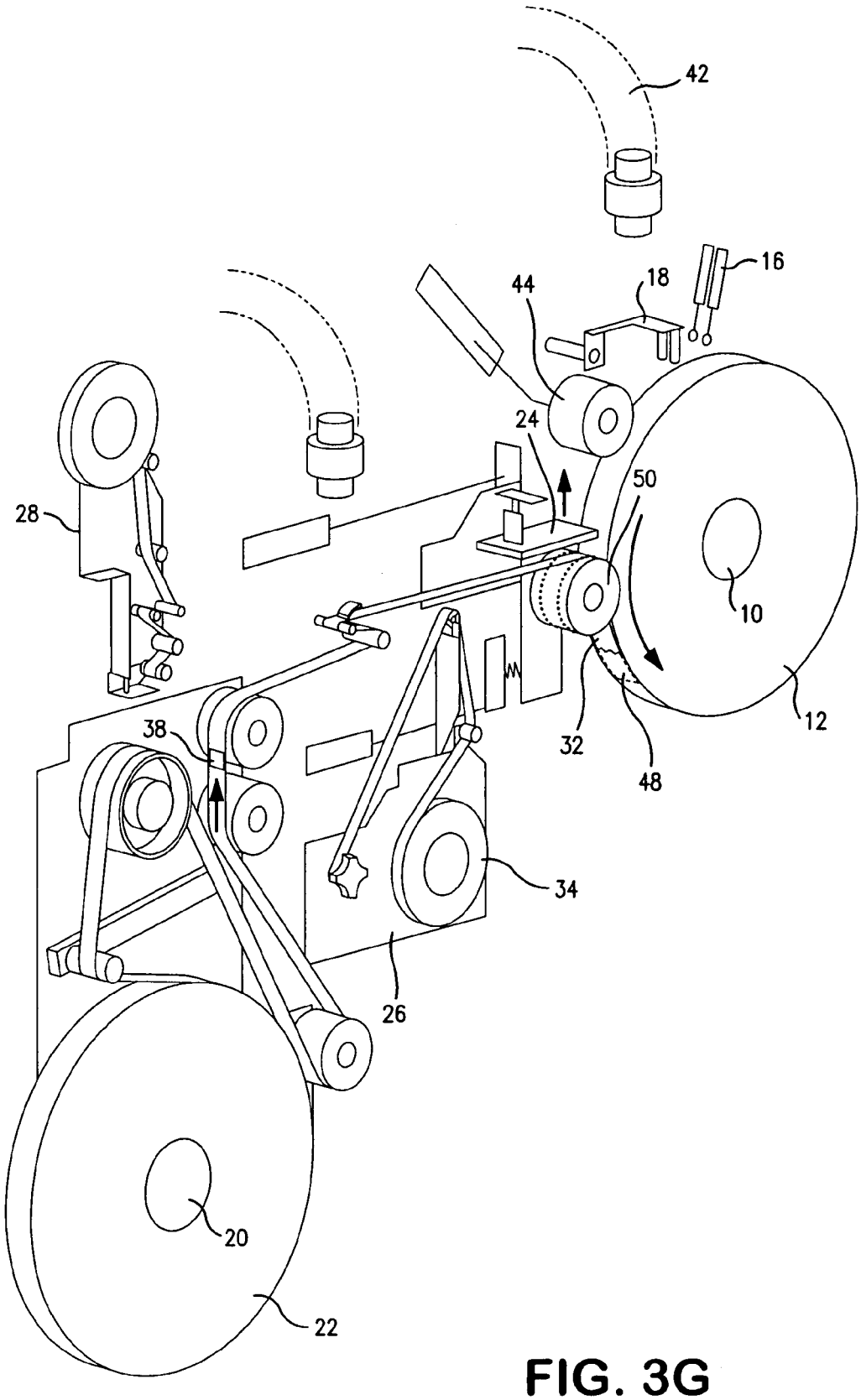

Referring to FIG. 3G, once the leading edge 48 of the bobbin is attached to the leading edge 32 of the overwrap material, the mandrel 10 is rotated causing the overwrap material to wind around the circumference of the bobbin. Rotation of the mandrel 10 also causes the overwrap material 22 to unwind and advance.

As shown in FIG. 3G, in this embodiment, the leading edge 32 of the overwrap material is positioned under the leading edge 48 of the paper. It should be understood, however, that in other embodiments the leading edge of the overwrap material may be over the leading edge of the paper.

Figure 3H:
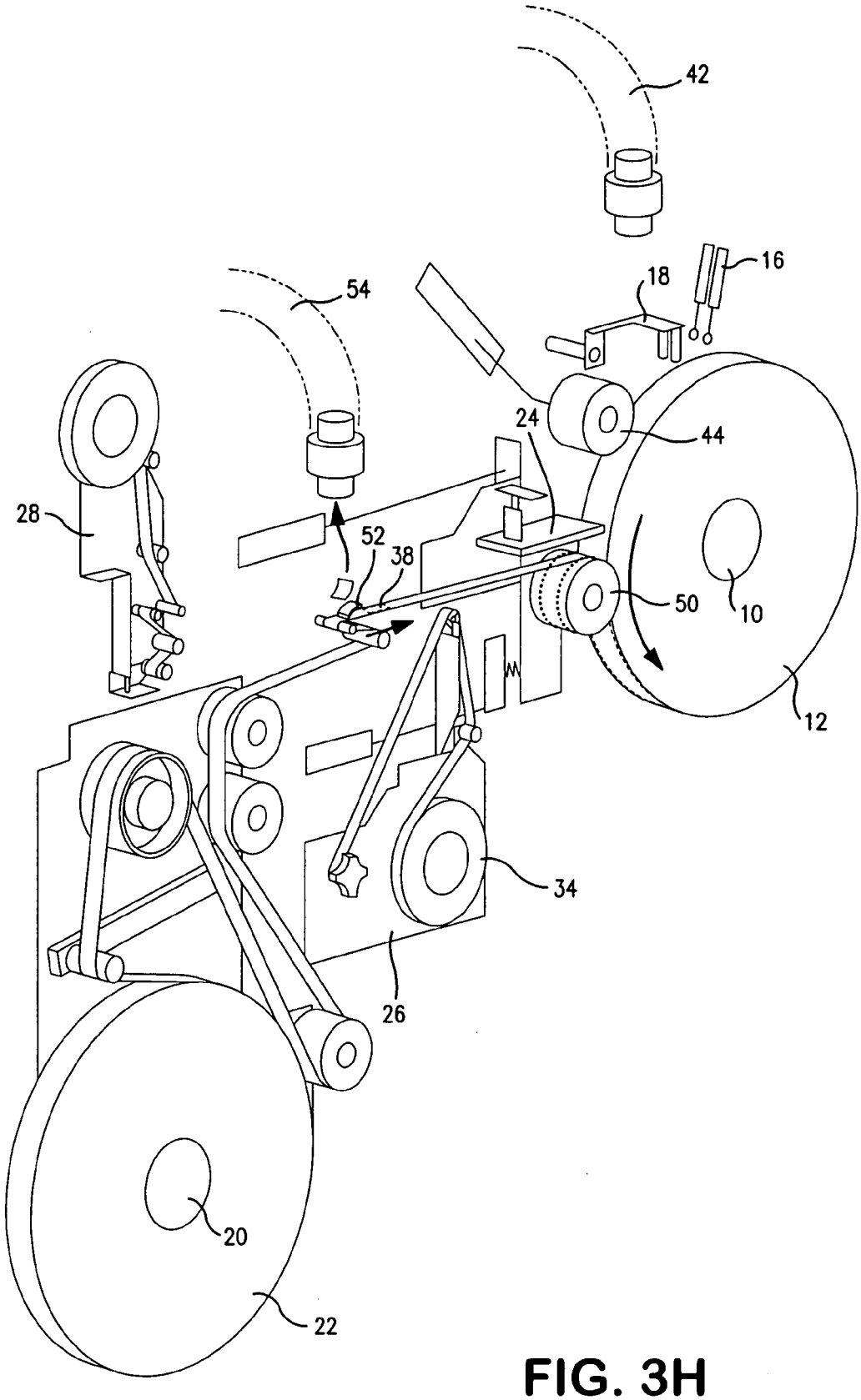

Referring to FIG. 3H, as the mandrel 10 continues to rotate and wrap the overwrap material around the circumference of the bobbin, the double-sided adhesive tape 38 contacts a backing removal device 52. The backing removal device 52 removes the backing member from the adhesive tape 38 thereby exposing the adhesive. In one embodiment, as shown, a vacuum hose 54 may be provided in order to capture the backing material that is removed.

In general, the backing removal device 52 can comprise any suitable device capable of removing the backing material without adversely affecting the adhesive. In one embodiment, for instance, the backing removal device 52 comprises a blade that engages the backing material as the overwrap material is advanced. If desired, the backing removal device 52 can be positioned adjacent to a guide roller having a relatively small diameter. In this manner, the backing material becomes more readily available for being removed from the adhesive layer.

Figure 3I:
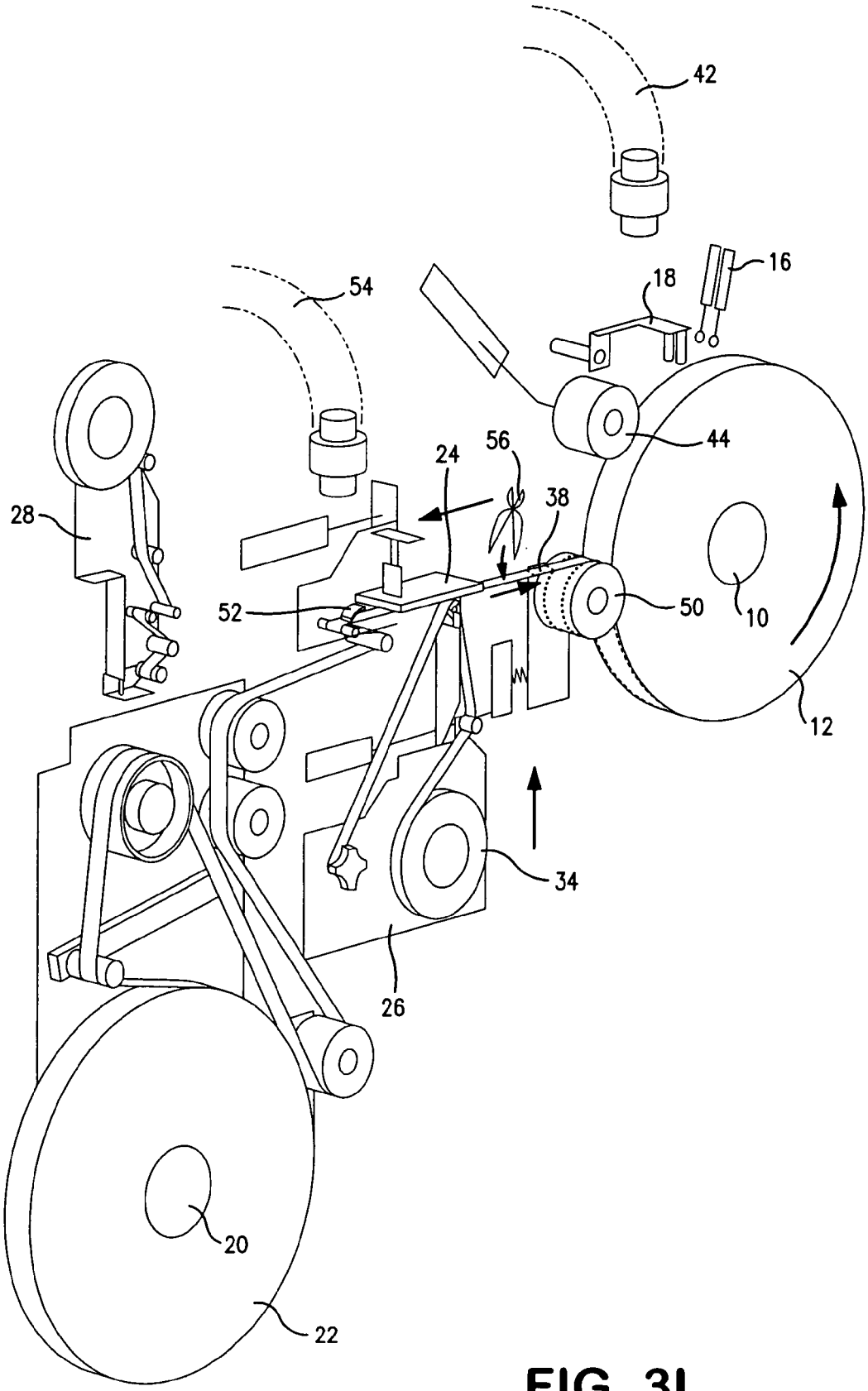
Figure 3J:
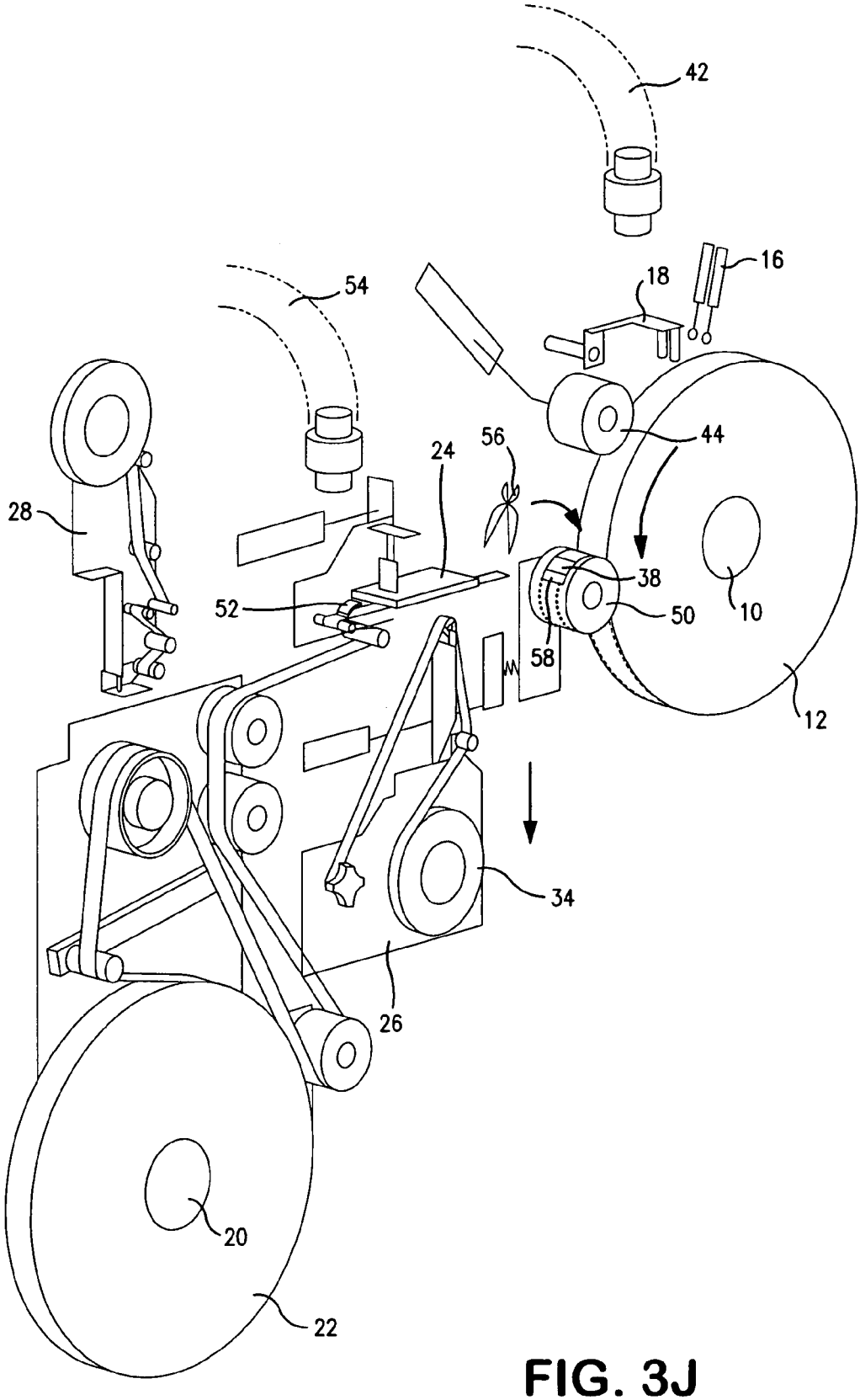

Referring to FIGS. 3I and 3J, as shown, the overwrap material 22 continues to advance and encircle the bobbin after the vacuum material is moved from the double-sided adhesive tape 38. As shown in FIG. 3I, the mandrel 10 is rotated until the adhesive tape is at a position for securing the overwrap material to the circumference of the bobbin 12. As shown particularly in FIG. 3I, the overwrap material 22 is cut upstream from the adhesive tape 38 as the overwrap material is advanced. In order to cut the overwrap material, a cutting device 56 is used.

The cutting device 56 can be any suitable cutting device capable of cutting, tearing or ripping the overwrap material. The cutting device 56, for instance, may be the same as the cutting device 46 as shown in FIG. 3C or may be different. In FIGS. 3I and 3J, the cutting device 56 is illustrated as a shearing device. Any suitable device, however, may be used.

Referring to FIG. 3J, after the overwrap material 22 is cut by the cutting device 56, the trailing edge of the overwrap material is formed that can be adhered to the outer circumference of the bobbin 12 by the adhesive tape 38. As shown, in one embodiment, the overwrap material can be cut upstream from the adhesive tape 38 in order to form a tab 58. The tab 58 can be used later to open the bobbin for use. For instance, a user can pull on the tab 58 in order to break the attachment between the adhesive tape and the outer circumference.

The amount of overwrap material that is placed on the bobbin 12 can vary depending upon the particular application. For example, in one embodiment, sufficient overwrap material may be placed on the bobbin so as to completely encircle the circumference. Alternatively, the overwrap material may encircle the bobbin more than once. In this manner, the adhesive tape 38 is adhered to another layer of overwrap material instead of directly to the paper or other material used to make the bobbin 12.

Referring back to FIG. 3I, in one embodiment, as the overwrap material is cut by the cutting device 56, the adhesive applicator 26 may be activated so as to apply an adhesive material to the overwrap material when a new leading edge of the overwrap material is formed by the cutting device 56. The adhesive applicator 26 may be activated in order to repeat the process when a new bobbin is placed on the mandrel 10.

Figure 2C:
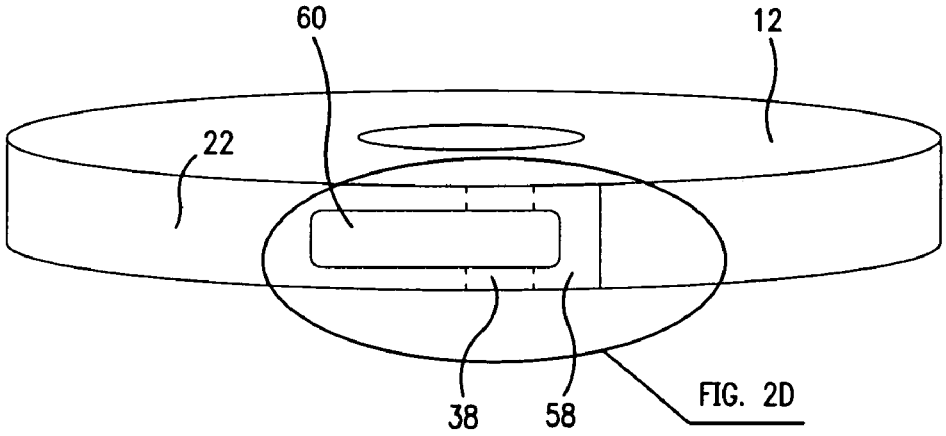
FIG. 2C is a perspective view and FIG. 2D is a plan view of a bobbin of material that has been wrapped by an overwrap material in accordance with the present disclosure.
Figure 2D:
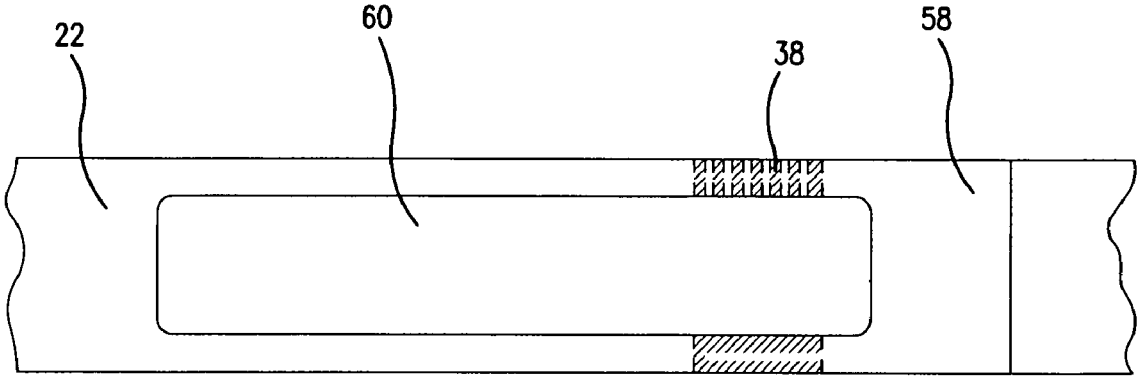

Referring to FIGS. 2C and 2D, a finished bobbin 12 is illustrated that has been wrapped with an overwrap material. As shown, the overwrap material 22 is adhered to the outer circumference of the bobbin by an adhesive tape 38. The adhesive tape is also spaced a distance from the edge of the overwrap material in order to form the tab 58.

The overwrap material 22 can be made from any suitable material. In one embodiment, for instance, the overwrap material may comprise a paper material. The overwrap material can have the same width as the bobbin of material, can have a width less than the bobbin of material or can have a width greater than the bobbin of material. In one particular embodiment, for instance, the overwrap material has a width that is approximately 0.5 mm less than the width of the bobbin.

The adhesive tape 38 and the tab 58 can also have various dimensions. In one embodiment, for instance, the adhesive tape 38 has a length of from about 15 mm to about 25 mm. The tab 58, on the other hand, can have a length from about 0.5 inches to about 4 inches, such as from about 0.5 inches to about 1 inch.

As shown in FIGS. 2C and 2D, if desired, a label 60 may be applied to the bobbin 12. The label 60, for instance, may supply information about the product, when it was made, and any other desired information. The label 60 can be automatically placed on the bobbin using a label dispenser or can be manually placed on the bobbin.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged either in whole or in part. Furthermore, those of ordinary skill in the art will appreciate that the foregoing description is by way of example only, and is not intended to limit the invention so further described in such appended claims.

What is claimed:

1. A method for overwrapping a bobbin comprising:

loading a bobbin of spirally wound paper on a mandrel, an outer layer of the paper being adhesively secured to the bobbin;

placing a break foot against an outer circumference of the bobbin;

pulling against the outer layer of the paper causing the outer layer to break at a location adjacent to the break foot;

unwinding the bobbin and removing at least a portion of the outer layer of paper, the outer layer of paper being broken in order to form a leading edge;

attaching the leading edge to an overwrap material by applying a first adhesive material in between the paper and the overwrap material;

winding the bobbin in order to wrap the overwrap material around the bobbin; and applying a second adhesive material to the overwrap material and cutting the overwrap material upstream of the second adhesive material to form a pullable tab as the overwrap material is adhered to the bobbin by the second adhesive material.

2. A method as defined in claim 1, wherein the break foot comprises a hydraulic or pneumatic actuator.

3. A method as defined in claim 1, wherein the outer layer is pulled at a location proximate to the break foot by applying a suction force against the outer layer.

4. A method as defined in claim 1, wherein the outer layer of paper is broken to form the leading edge by a cutting device.

5. A method as defined in claim 1, wherein, after the leading edge is formed, the leading edge is drawn against a vacuum roll positioned adjacent to the bobbin.

6. A method as defined in claim 1, wherein the overwrap material is unwound from a roll, a leading edge of the overwrap material being held by a suction force created by a moveable vacuum plate, the moveable vacuum plate being configured to move towards the leading edge of the paper for attaching the leading edge of the paper to the leading edge of the overwrap material.

7. A method as defined in claim 1, wherein the bobbin of paper comprises a cigarette wrapping paper.

8. A method as defined in claim 1, wherein the second adhesive material comprises a two-sided tape.

9. A method as defined in claim 1, wherein the second adhesive material is applied to the overwrap material at a distance upstream from the bobbin that is equal to or greater than 75% of the circumference of the bobbin.

* * * * *